United States Patent [19]

Emming

[11] Patent Number: 5,029,766

[45] Date of Patent: Jul. 9, 1991

[54] REEL-CARRYING APPARATUS FOR CABLE INSTALLERS

[75] Inventor: Joseph L. Emming, Wichita, Kans.

[73] Assignee: J. I. Case Company, Racine, Wis.

[21] Appl. No.: 468,236

[22] Filed: Jan. 22, 1990

[51] Int. Cl.[5] ..... B65H 75/00

[52] U.S. Cl. ..... 242/54 R; 242/129.6; 242/86.5 R

[58] Field of Search ..... 242/54 R, 68.4, 68, 242/129.6, 129.62, 86.5 R, 58.6

[56] References Cited

U.S. PATENT DOCUMENTS

| | | | |
|---|---|---|---|
| 1,603,394 | 10/1926 | McPhee | 242/129.6 |
| 2,526,029 | 10/1950 | Judelson | 242/68 X |
| 2,632,607 | 3/1953 | Heygel | 242/129.6 X |
| 3,780,813 | 12/1973 | Davis et al. | 172/438 |
| 3,926,263 | 12/1975 | Frisbee et al. | 172/801 |
| 4,191,342 | 3/1980 | Reinhold | 242/68 |
| 4,391,422 | 7/1983 | McDonald | 242/129.6 |

FOREIGN PATENT DOCUMENTS

| | | | |
|---|---|---|---|
| 472005 | 9/1937 | United Kingdom | 242/129.6 |

*Primary Examiner*—John M. Jillions

*Attorney, Agent, or Firm*—Peter N. Jansson, Ltd.

[57] ABSTRACT

The invention is improved reel-carrying apparatus for facilitating cable-installing operations of the type with a carrier frame and a shaft supported at its opposite end portions by cradles on the frame. Bearings are secured to the shaft end portions, such bearings having inner members on the shaft end portions and outer members resting in the cradles, the outer member cross-dimensions fitting through the reel center hole. The outer portions preferably have cross-dimensions less than the cross-dimension of the shaft to protect the bearings during insertion and removal from the reel.

16 Claims, 3 Drawing Sheets

REEL-CARRYING APPARATUS FOR CABLE INSTALLERS

FIELD OF THE INVENTION

This invention is related generally to cable installing implements for burying cable or for stringing it overhead and, more particularly, to reel-carrying apparatus of such cable installing implements.

BACKGROUND OF THE INVENTION

Successful manipulation of cable during cable-laying or cable-stringing operations requires some of the brute force and strength necessary in heavy construction and some of the accuracy and care necessary in sewing. Cables installed using tractor-driven implements are often of substantial size and weight while at the same time having many strands which are relatively fragile.

Because of this it is desirable to avoid unnecessary applications of force on the cable. And, to minimize the amount of human effort required for accurate cable installation it is desirable that the cable-handling implements operate properly.

A significant part of cable-laying and cable-stringing operations involves unreeling of cable, usually as a vehicle moves along the path of cable installation. Cable typically is provided to cable installers on large reels which when full of cable weigh as much as thousands of pounds. Such reels have center holes through which a shaft (spindle) extends to support the reel during unreeling.

A wide variety of cable-installing equipment has been developed over the years. Some examples of the prior art devices are disclosed in U.S. Pat. Nos. 3,780,813 and 3,926,263.

Cable-installing equipment typically has reel-carrying apparatus which includes a carrier frame with frame arms along opposite ends of the reel, opposed cradles on the frame arms, and a shaft extending through the center hole and having shaft end portions held in the cradles to support the reel between the frame arms. While such apparatus of the prior art is adequate, a number of problems and shortcomings of such equipment are well known to those who utilize such equipment in the field.

One well known problem in cable-laying is that, unless special steps are taken by the equipment operators, cable which has been laid slides along the trench because unreeling is resisted too much. This problem is seen most often during laying of the first portions of a line and during the early turns of the reel. It is these times when resistance to unreeling is greatest due to reel weight and resistance to in-trench sliding is least because of the light weight of cable already laid.

These problems are often dealt with by operators finding some way to apply downward force on the cable to pin it against the ground and prevent unwanted sliding. This sometimes involves more than one man standing on the cable. This, of course, takes operators away from other needed tasks and represents an expensive inefficiency.

Significant resistance to unreeling is a problem not only because of unwanted cable sliding in a trench, but also because of the fact that excessive pulling exerts force on cable which can tend to damage it, that is, damage parts of it. Excessive pulling to unreel cable, and all the related difficulties, are a significant problem with implements of the prior art.

Because of such problems, smaller and lighter (less filled) reels may sometimes be preferred. This, of course, leads to the necessity of more frequent reel changes during extended cable-installation operations. Using larger reels which are completely filled is highly desirable.

Various steps have been taken in the prior art to minimize the above-noted problems. For example, operators often will apply grease along the length of the shaft which extends through the reel in order to reduce the unreeling friction. This is helpful, but is less than a satisfactory solution for a number of reasons. For example, grease is often quickly absorbed by the reel, necessitating regreasing. Furthermore, grease along the shaft can be troublesome to deal with when the shaft is removed from a used reel and inserted into an unused reel.

In other cases the aforementioned cradle for the ends of the shaft (spindle) has been made of a pair of spaced rollers. This facilitates turning of the shaft, as opposed to turning of the reel on a stationary, or relatively stationary, shaft. However, for a variety of reasons this has not been an adequate solution to the problems mentioned above. For one thing, the shaft ends are prone to fall off such rollers, particularly as the frame arms are rotated upwardly or downwardly along their arc of travel to lift or lower the reel.

While various solutions have been tried, there remains a need for an improved reel-carrying apparatus for cable installing equipment of the type with a carrier frame and a shaft supported by the frame for holding a reel of cable.

OBJECTS OF THE INVENTION

It is an object of this invention to provide an improved reel-carrying apparatus for cable-laying and cable-stringing equipment which overcomes some of the problems and shortcomings of the prior art.

Another object is to provide a reel-carrying apparatus with a better combination of weight-bearing strength and unreeling accuracy.

Another object of this invention is to provide an improved reel-carrying apparatus which minimizes the amount of human effort necessary for accurate cable installation of heavy cable.

Another object of this invention is to provide an improved reel-carrying apparatus which minimizes unreeling problems.

Another object of this invention is to provide an improved reel-carrying apparatus which unreels as well with a full reel as with a reel which is nearly empty, and as well when only a short length of cable has been laid as when a long length has been laid.

Another object of this invention is to provide an improved reel-carrying apparatus which does not cause cable to slide accidentally along the trench in which it is being laid.

Another object of this invention is to provide an improved reel-carrying apparatus for which it is unnecessary to stand on laid cable or otherwise hold it against the ground in order to prevent unwanted sliding.

Another object of this invention is to provide an improved reel-carrying apparatus which prevents damage to cable during unreeling operations.

Another object of this invention is to provide an improved reel-carrying apparatus with good unreeling qualities which is easy to load and unload with heavy cable reels.

Another object of this invention is to provide an improved reel-carrying apparatus with good unreeling qualities which does not require greasing along a spindle.

Another object of this invention is to provide an improved reel-carrying apparatus with both good unreeling qualities and stability during cable-laying operations.

These and other important objects will be apparent from the descriptions of this invention which follow.

SUMMARY OF THE INVENTION

This invention is an improved reel-carrying apparatus for dispensing cable from reels (typically large heavy reels) during cable-laying and cable-stringing operations. The apparatus of the invention overcomes certain problems and shortcomings of the prior art, including those mentioned above.

The invention is a reel-carrying apparatus of the type having a carrier frame with frame arms along opposite ends of the reel, opposed cradles on the frame arms, and a shaft extending through the reel center hole with shaft end portions in the cradles to support the reel between the frame arms. The apparatus includes a bearing secured to each end portion of the shaft, each bearing having an inner annular member on one shaft end portion and an outer annular member resting in one of the cradles, the outer annular member having a cross-dimension which fits through the reel center hole. Removable retainer means on both of the cradles contact the bearings to prevent the shaft from falling out of the cradles.

In preferred embodiments, the shaft end portions have necked-in portions engaging the bearing inner annular portions and means on either axial side of the bearing to maintain the axial position of the bearing on the shaft end portion. The outer annular portions of the bearings preferably have cross-dimensions not exceeding the shaft cross-dimension. The bearing cross-dimensions are most preferably less than the shaft cross-dimension, since this is best to facilitate insertion and removal of the shaft from the reel center hole and to protect the bearings during such insertion and removal.

Each cradle has a base and a pair of side walls extending therefrom. Such side walls are preferably spaced from one another by a distance greater than the cross-dimension of the bearing outer annular portion such that the outer annular portion will rest freely in the cradle without being compressed between the walls. This facilitates loading and unloading of the reel-carrying shaft from the frame.

DETAILED DESCRIPTIONS OF PREFERRED EMBODIMENTS

Figure 1:
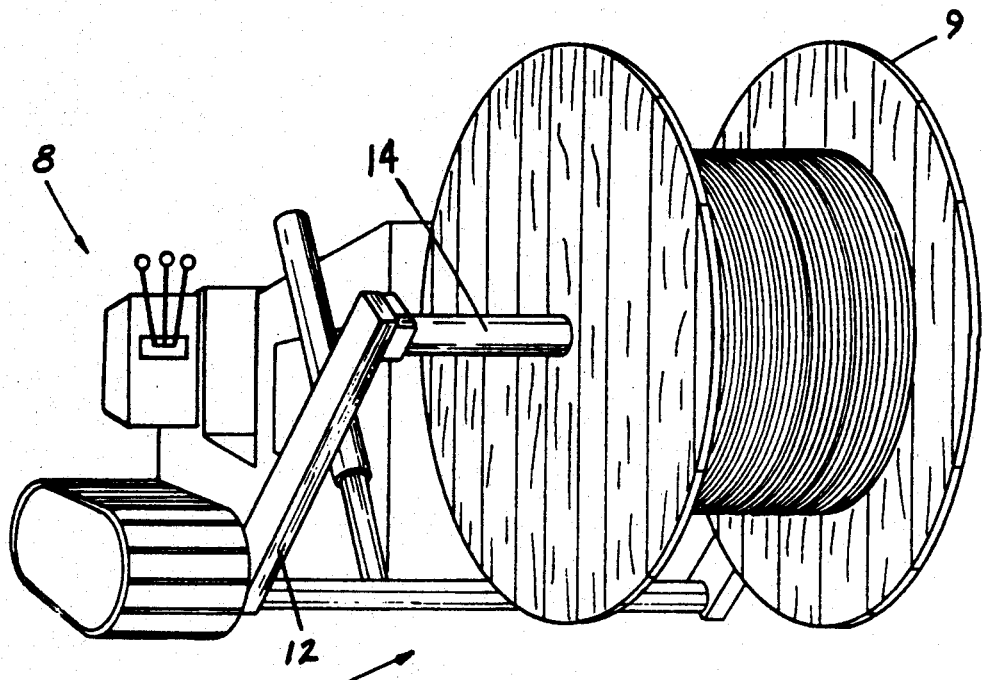
FIG. 1 is a fragmentary perspective view of equipment for cable-laying operations including a reel-carrying apparatus in accordance with this invention.

As shown in FIG. 1, a tractor 8 has a reel-carrying apparatus 10 which supports a reel 9 of cable used in the laying or overhead stringing of cable. Reel-carrying apparatus 10 has two frame arms 12 and a shaft 14 which extends through the center hole of reel 9 and is supported between frame arms 12. Reel 9 unwinds to provide cable to a trench or an overhead support system.

Frame 12 may be raised and lowered through engagement with hydraulic apparatus in order to lift reel 9 from the ground so that it may turn during unreeling operations. During loading, shaft 14, in a position free of its attachment to frame arms 12, is inserted through the reel center hole such that shaft end portions 14B protrude from either side. Such end portions are engaged by frame arms 12 to lift reel 9 from the ground to a position of where it is held during unreeling.

Figure 2:
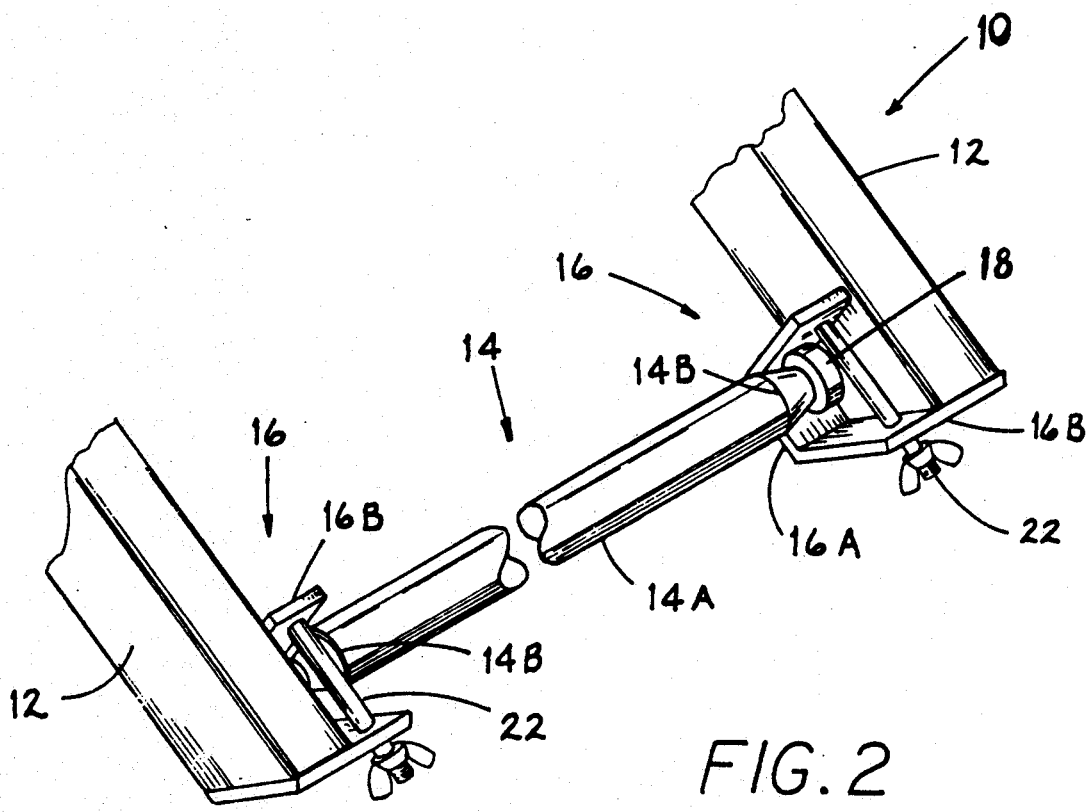
FIG. 2 is a fragmentary perspective view of the reel-carrying apparatus of this invention.
Figure 3:
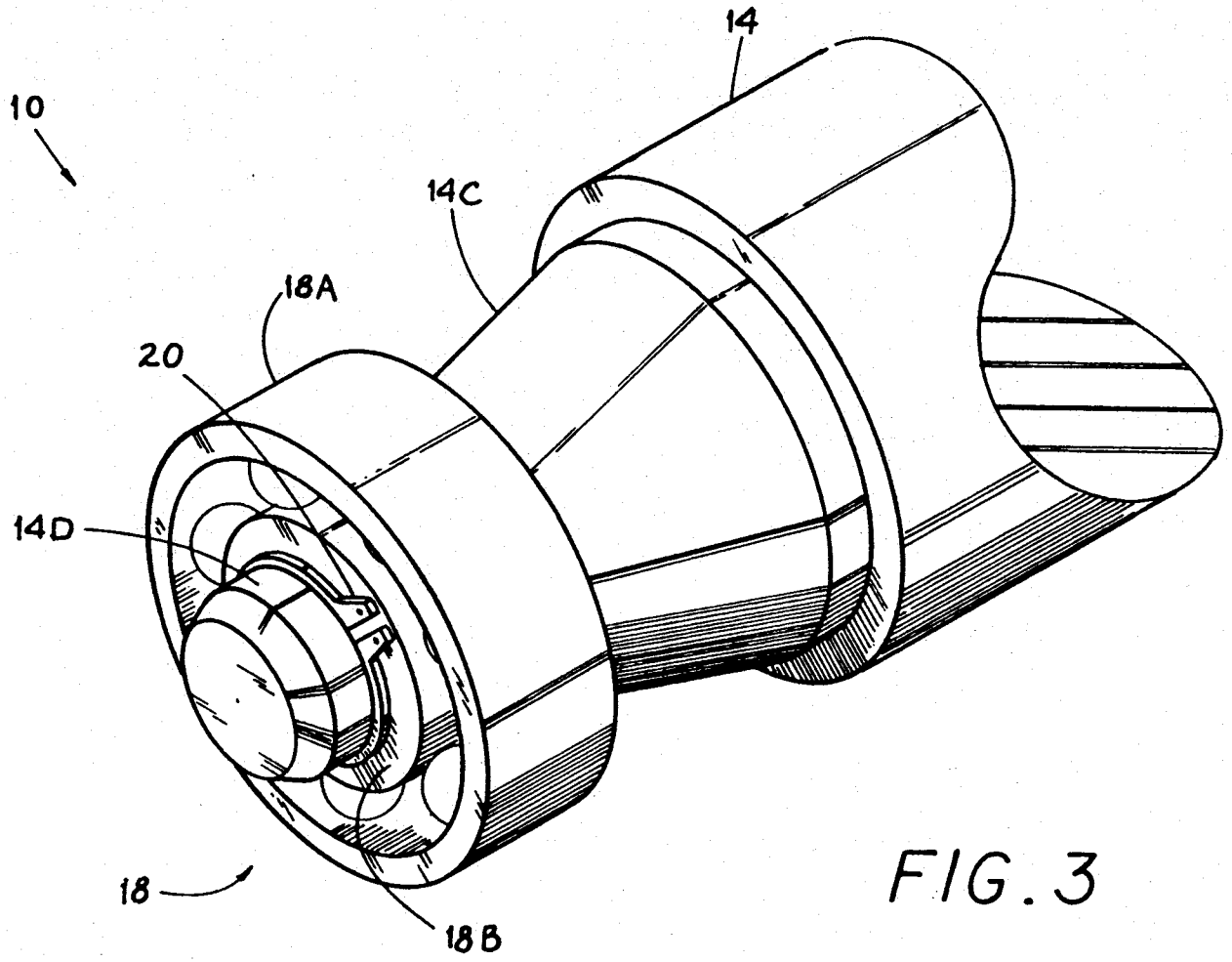
FIG. 3 is an enlarged perspective of the shaft end and bearing shown in FIG. 2.
Figure 4:
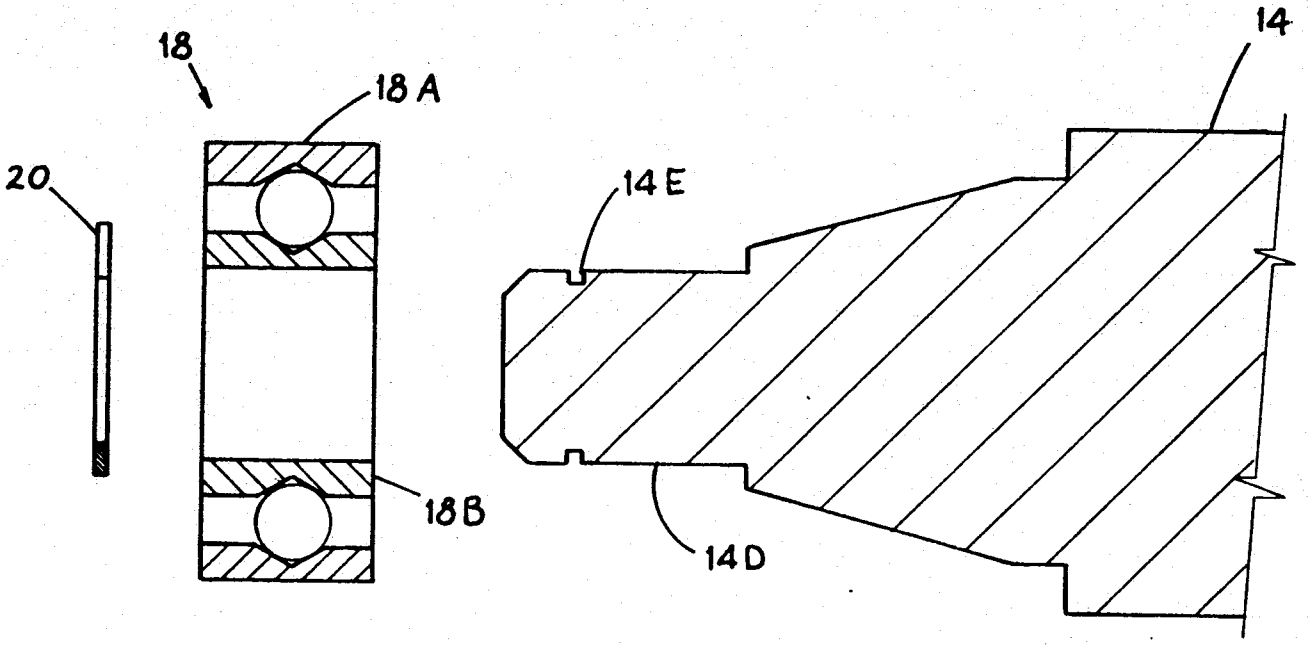
FIG. 4 is an exploded elevation of FIG. 3.

FIGS. 2–4 show the details of the invention. On frame arms 12 are two opposed cradles 16 which support shaft 14 therebetween. Each of the cradles 16 includes a cradle base 16A and a pair of cradle walls 16B extending from base 16A. Shaft end portions 14B extend into cradles 16.

Shaft 14 has a shaft main portion 14A with a generally fixed outer cross-dimension which fits through the reel center hole. Shaft end portions 14B have tapered portions 14C which terminate in necked-in portions 14D on which bearings 18 are mounted. Each bearing 18 has an outer annular member 18A and an inner annular member 18B. Each inner annular member 18B is tightly engaged over necked-in portion 14D of shaft 14.

Each bearing 18 is maintained in its axial position on necked-in portion 14D by shaft tapered portion 14C on one side and a snap ring 20 on the other side. Snap rings 20 engage snap ring slots 14E, and can easily be removed when replacement of bearings is necessary.

A pin 22 extends between cradle walls 16B in a position to prevent bearing 18 from falling out of cradle 16. Pins 22 may be bolts with wing nuts or another similar device, or they may be bolts which are threaded directly into cradle walls 16B.

Each outer annular member 18B has an outer cross-dimension which is somewhat less than the outer cross-dimension of shaft main portion 14A. This allows bearing 18 to fit through the reel center hole and facilitates insertion and removal of shaft 14 from such center hole. During such insertion and removal, bearing 18 is supported on shaft 14 free of forceful contact with reel 9.

Cradle walls 16B are spaced from one another by a distance greater than the outer cross-dimension of outer annular member 18A of bearing 18. Therefore, outer annular members 18A of bearing 18 rest freely in cradle 16, without being compressed between cradle walls 16B.

Bearings 18 may be roller bearings, ball bearings or the like. Bearings 18 must be made of sturdy materials, and bearings 18 must be of sufficient size to readily bear the extreme loads represented by full cable coils. Bearing capacity is based upon the rated capacity of reel-carrying apparatus 10, taking into consideration any dynamic loading effects.

While the principles of this invention have been described in connection with specific embodiments, it should be understood clearly that these descriptions are made only by way of example and are not intended to limit the scope of the invention.

I claim:

1. In a reel-carrying apparatus for cable installing equipment of the type with a carrier frame and a shaft having opposite end portions supported by the frame and having along its entire length an outer cross-dimension which fits through the reel center hole, the improvement comprising:

two opposed spaced cradles on the frame;

the shaft having said opposite end portions within the cradles; and a bearing secured to each of the opposite end portions, each bearing having an inner annular member on one of the shaft end portions and an outer annular member resting in one of the cradles, the outer annular member having a cross-dimension which fits through the reel center hole and does not exceed the outer cross-dimension of the shaft at any point along the shaft length, thereby facilitating cable installation operations by providing free turning of the cable reel while preserving normal practices of ready insertion of either end of the shaft into either end of the reel center hole, and ready shaft withdrawal in either direction.

2. The reel-carrying apparatus of claim 1 further including removable retainer means on the cradles to prevent the bearings from falling out of the cradles.

3. The reel-carrying apparatus of claim 1 wherein each of the shaft end portions has a necked-in portion engaging the bearing inner annular member and means on either axial side of the bearing to maintain the axial position of the bearing on the shaft end portion.

4. The reel-carrying apparatus of claim 3 wherein the cross-dimension of the outer annular member of each of the bearings is less than the shaft cross-dimension, thereby facilitating insertion and removal of the shaft from the reel center hole and protecting the bearings during such insertion and removal.

5. The reel-carrying apparatus of claim 4 further including removable retainer means on the cradles to prevent the bearings from falling out of the cradles.

6. The reel-carrying apparatus of claim 1 wherein each cradle has a base and a pair of walls extending therefrom and spaced from one another by a distance greater than the cross-dimension of the bearing outer annular member such that the outer annular member will rest freely in the cradle without being compressed between the walls, thereby facilitating loading and unloading of the reel-carrying shaft from the frame.

7. The reel-carrying apparatus of claim 6 further including removable retainer means on the cradles to prevent the bearings from falling out of the cradles.

8. The reel-carrying apparatus of claim 6 wherein each of the shaft end portions has a necked-in portion engaging the bearing inner annular member and means on either axial side of the bearing to maintain the axial position of the bearing on the shaft end portion.

9. The reel-carrying apparatus of claim 8 wherein the cross-dimension of the outer annular member of each of the bearings is less than the shaft cross-dimension, thereby facilitating insertion and removal of the shaft from the reel center hole and protecting the bearings during such insertion and removal.

10. The reel-carrying apparatus of claim 9 further including removable retainer means on the cradles to prevent the bearings from falling out of the cradles.

11. In an apparatus for dispensing cable of the type having a reel of cable with a center hole, a carrier frame with frame arms along opposite ends of the reel, opposed cradles on the frame arms, and a shaft extending through the center hole and having opposite end portions in the cradles to support the reel between the frame arms, the improvement comprising a bearing secured to each of the opposite end portions, each bearing having an inner member on one of the shaft end portions and an outer member resting in one of the cradles, the outer member having a cross-dimension which fits through the reel center hole and does not exceed the outer cross-dimension of the shaft at any point along the shaft length, thereby facilitating cable installation operations by providing free turning of the cable reel while preserving normal practices of ready insertion of either end of the shaft into either end of the reel center hole, and ready shaft withdrawal in either direction.

12. The cable-dispensing apparatus of claim 11 wherein the cross-dimension of the outer member of each of the bearings is less than the shaft cross-dimension, thereby facilitating insertion and removal of the shaft from the reel center hole and protecting the bearings during such insertion and removal.

13. The cable-dispensing apparatus of claim 12 further including removable retainer means on the cradles to prevent the bearings from falling out of the cradles.

14. The cable-dispensing apparatus of claim 11 wherein each cradle has a base and a pair of walls extending therefrom and spaced from one another by a distance greater than the cross-dimension of the bearing outer member such that the outer member will rest freely in the cradle without being compressed between the walls, thereby facilitating loading and unloading of the reel-carrying shaft from the frame.

15. The cable-dispensing apparatus of claim 14 wherein the cross-dimension of the outer member of each of the bearings is less than the shaft cross-dimension, thereby facilitating insertion and removal of the shaft from the reel center hole and protecting the bearings during such insertion and removal.

16. The cable-dispensing apparatus of claim 15 further including removable retainer means on the cradles to prevent the bearings from falling out of the cradles.

* * * * *